US010847074B2

(12) United States Patent
Lee et al.

(10) Patent No.: US 10,847,074 B2
(45) Date of Patent: Nov. 24, 2020

(54) DISPLAY DRIVING CIRCUIT

(71) Applicant: Au Optronics Corporation, Hsinchu (TW)

(72) Inventors: Ming-Hsien Lee, Hsinchu (TW); Che-Chia Chang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/508,308

(22) Filed: Jul. 11, 2019

(65) Prior Publication Data

US 2020/0051479 A1 Feb. 13, 2020

Related U.S. Application Data

(60) Provisional application No. 62/717,260, filed on Aug. 10, 2018.

(30) Foreign Application Priority Data

Feb. 25, 2019 (TW) ..... 108106217 A

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01); *G09G 2310/0267* (2013.01); *G09G 2330/021* (2013.01)

(58) Field of Classification Search
CPC ... G09G 2310/0283; G09G 2310/0267; G09G 2300/0408; G09G 2300/0426; G09G 3/20; G09G 3/2677; G09G 3/3266; G09G 2330/021
See application file for complete search history.

(56) References Cited

U.S. PATENT DOCUMENTS

| | | | | |
|---|---|---|---|---|
| 9,558,721 | B2 | 1/2017 | Sakariya et al. | |
| 10,504,408 | B2 * | 12/2019 | Han | G09G 3/3677 |
| 2002/0196241 | A1 * | 12/2002 | Morita | G09G 3/3677 345/204 |
| 2012/0019508 | A1 | 1/2012 | Wei et al. | |

(Continued)

FOREIGN PATENT DOCUMENTS

| | | |
|---|---|---|
| CN | 106504722 | 3/2017 |
| TW | 201205537 | 2/2012 |
| TW | 201419258 | 5/2014 |

*Primary Examiner* — Ariel A Balaoing
(74) *Attorney, Agent, or Firm* — JCIPRNET

(57) ABSTRACT

A display driving circuit is provided. The display driving circuit includes: at least one gate driving circuit, each of the at least one gate driving circuit generating a driving signal so that display pixels update pixel data according to each of the driving signals; and at least two enable-selecting circuits, generating a zone start-updating signal and a zone end-updating signal according to a zone scan-control signal and the driving signals and enabling the at least one gate driving circuit of a first portion according to the zone start-updating signal and the zone end-updating signal. In this way, the at least one gate driving circuit of the first portion generates the driving signals to update part of the display pixels, and that power saving is achieved.

12 Claims, 8 Drawing Sheets

(56) References Cited

U.S. PATENT DOCUMENTS

| | | | | |
|---|---|---|---|---|
| 2013/0222357 | A1* | 8/2013 | Tseng | G09G 3/3677 345/212 |
| 2014/0049512 | A1* | 2/2014 | Yang | G06F 3/0416 345/174 |
| 2014/0104243 | A1 | 4/2014 | Sakariya et al. | |
| 2015/0154902 | A1* | 6/2015 | Lee | G09G 3/20 345/213 |
| 2018/0197455 | A1* | 7/2018 | Han | G09G 3/3677 |

* cited by examiner

501

DISPLAY DRIVING CIRCUIT

CROSS-REFERENCE TO RELATED APPLICATION

This application claims the priority benefit of U.S. provisional application Ser. No. 62/717,260, filed on Aug. 10, 2018, and Taiwan application serial no. 108106217, filed on Feb. 25, 2019. The entirety of each of the above-mentioned patent applications is hereby incorporated by reference herein and made a part of this specification.

BACKGROUND

Technical Field

The invention relates to a display driving circuit.

Description of Related Art

FIG. 1A is a schematic diagram of a display driving circuit of the related art. Herein, each gate driving circuit of a plurality of gate driving circuits GOA[1] to GOA[8] sequentially generates driving signals SR[1]~SR[8] in time to update data of a display pixel, so that a display frame is updated. As shown in FIG. 1A, taking the gate driving circuit GOA[5] for example, the gate driving circuit GOA[5] includes an input interface configured to receive an enable signal ES and a disable signal DS. The gate driving circuits GOA[1] to GOA[8] sequentially perform a scanning action and sequentially generates the enabled driving signals SR[1] to SR[8] under normal operation. The first stage gate driving circuit GOA[1] may receive an auxiliary start-updating signal ST, and the last stage gate driving circuit GOA[8] may receive an auxiliary end-updating signal END, so that the scanning action performed by the gate driving circuits GOA[1] to GOA[8] may be controlled.

As shown in FIG. 1B, the multiple groups of the gate driving circuits GOA[1] to GOA[4] and GOA[5] to GOA[8] respectively correspond to a plurality of zones Z1 to Z2 of the display, and only part of a frame of the display is required to be updated, for example, only the first zone Z1 or the second zone Z2 is required to be updated. Compared to FIG. 1A, in the related art, a plurality of groups of auxiliary start-updating signals and auxiliary end-updating signals are additionally added, one group of the auxiliary start/auxiliary end-updating signal (ST1/END1) is set to control the first zone of the display frame, and the other group of the auxiliary start/auxiliary end-updating signal (ST2/END2) is set to control the second zone of the display frame. Nevertheless, in this way, the number of groups of the auxiliary start/auxiliary end-updating signals may increase along with an increase in the number of zones to be locally updated in the display frame. For instance, as shown in FIG. 1C, when the number of zones to be locally updated become four, four groups of the corresponding auxiliary start/auxiliary end-updating signals are required to control each of the zones. The increase in groups of the auxiliary start/auxiliary end-updating signals means an increase in signal lines. As such, the screen border of the display becomes wider.

SUMMARY

The invention provides a display driving circuit capable of saving a layout area and reducing a size of a screen border.

An embodiment of the invention provides a driving circuit of a display. The driving circuit of the display includes a plurality of gate driving circuit groups, corresponding to a plurality of display regions of the display, each of the gate driving circuit groups generating a plurality of driving signals to drive each of the corresponding display regions; and a plurality of scan-control signal generators, corresponding to the gate driving circuit groups. Herein, the Nth stage scan-control signal generator receives a front stage driving signal, a rear stage driving circuit, an auxiliary start-updating signal, and an auxiliary end-updating signal, selects one of the front stage driving signal and the auxiliary start-updating signal to generate a zone start-updating signal according to a zone scan-control signal, and selects one of the rear stage driving circuit and the auxiliary end-updating signal to generate a zone end-updating signal according to the zone scan-control signal. Herein, the Nth stage gate driving circuit group performs a gate scanning action according to the zone start-updating signal and the zone end-updating signal. N is a positive integer.

To sum up, in the display driving circuit provided by the invention, the zone start/zone end-updating signal may be dynamically generated to each of the zones to be locally updated to locally update the display frame. Further, the screen border occupied by the display driving circuit is not affected by the number of the zones to be locally updated in the display frame, and therefore, the slim border effect is provided and power saving is achieved.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Embodiments of the invention are described hereinafter with reference to the drawings.

Figure 1A:
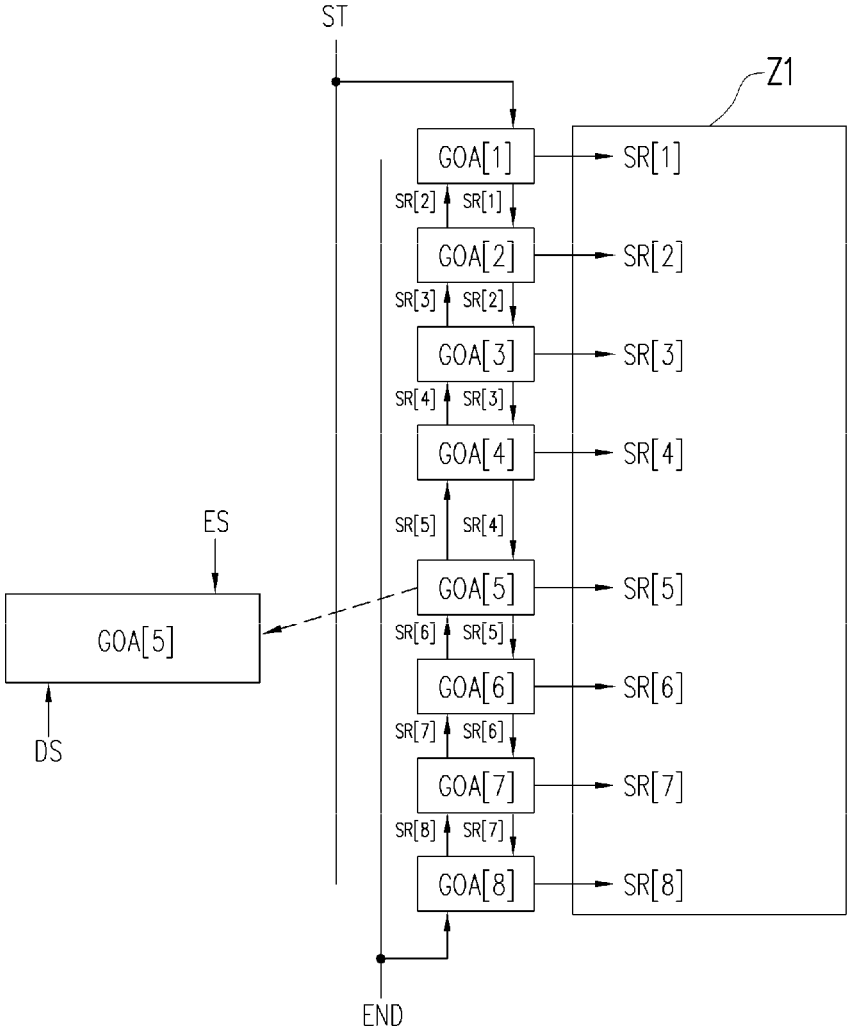
FIG. 1A(PRIOR ART)
FIG. 1A-FIG. 1C are schematic diagrams of a display driving circuit of the related art.
Figure 1B:
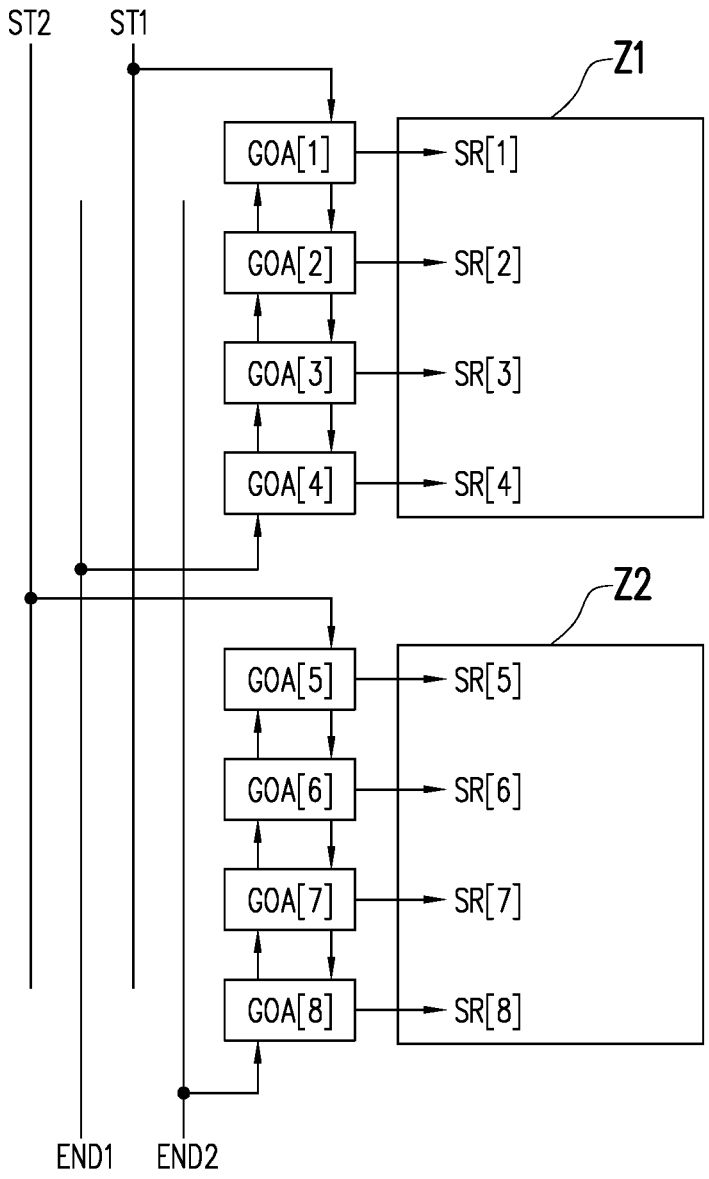
Figure 1C:
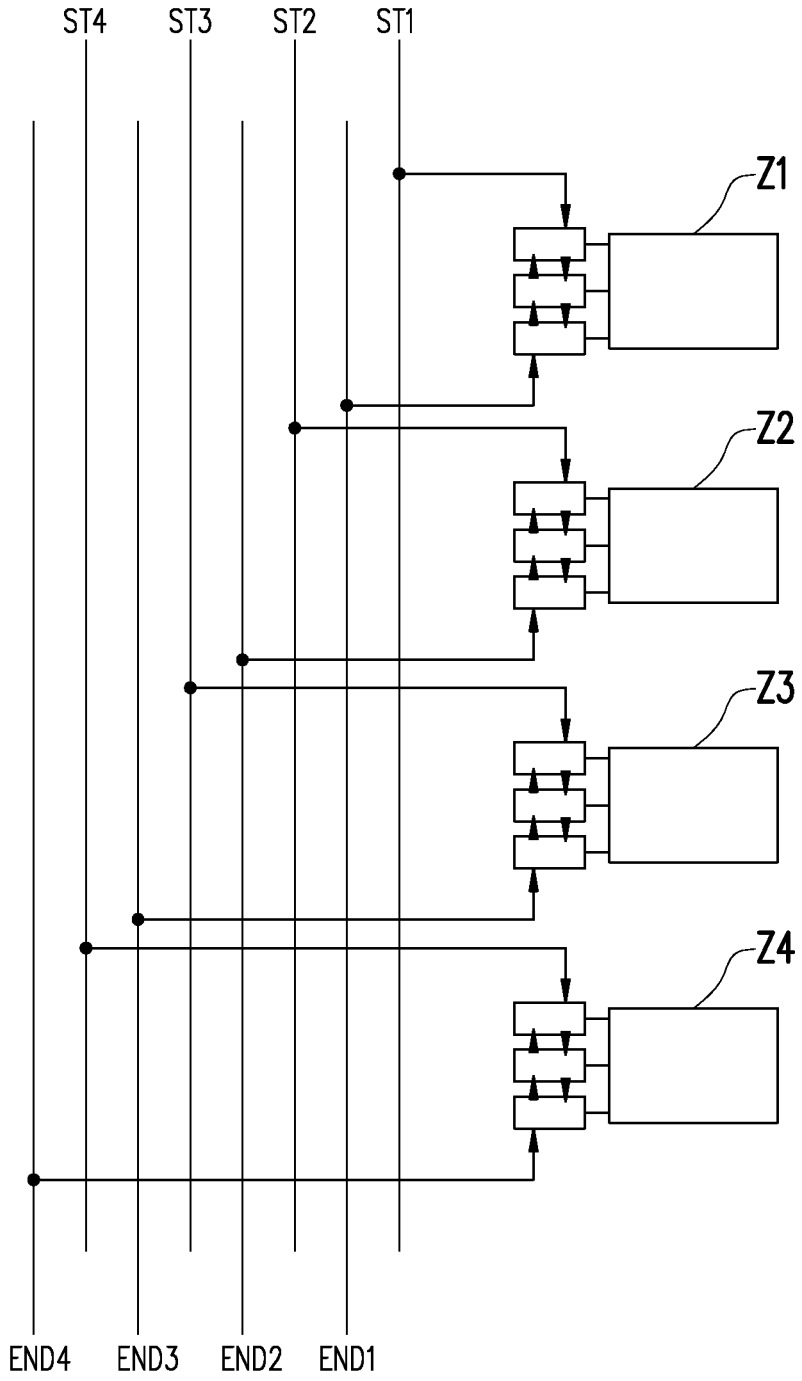
Figure 2B:
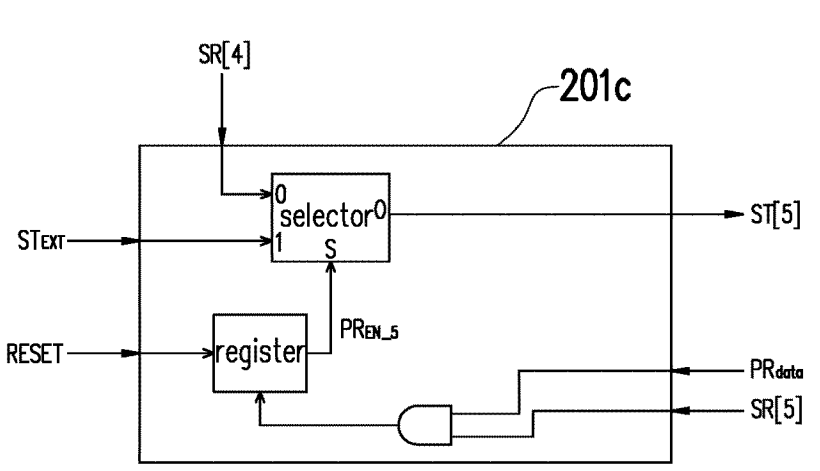
FIG. 2A to FIG. 2C are schematic diagrams of a display driving circuit according to an embodiment of the invention.
Figure 2C:
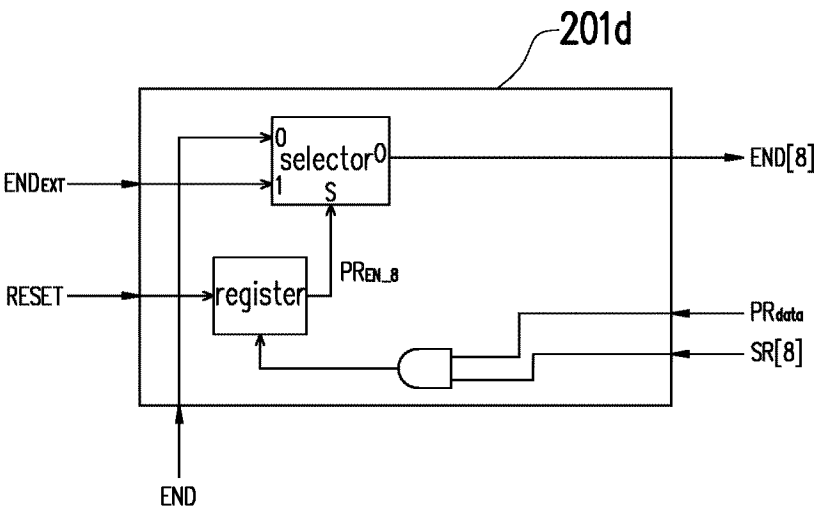
Figure 2A:
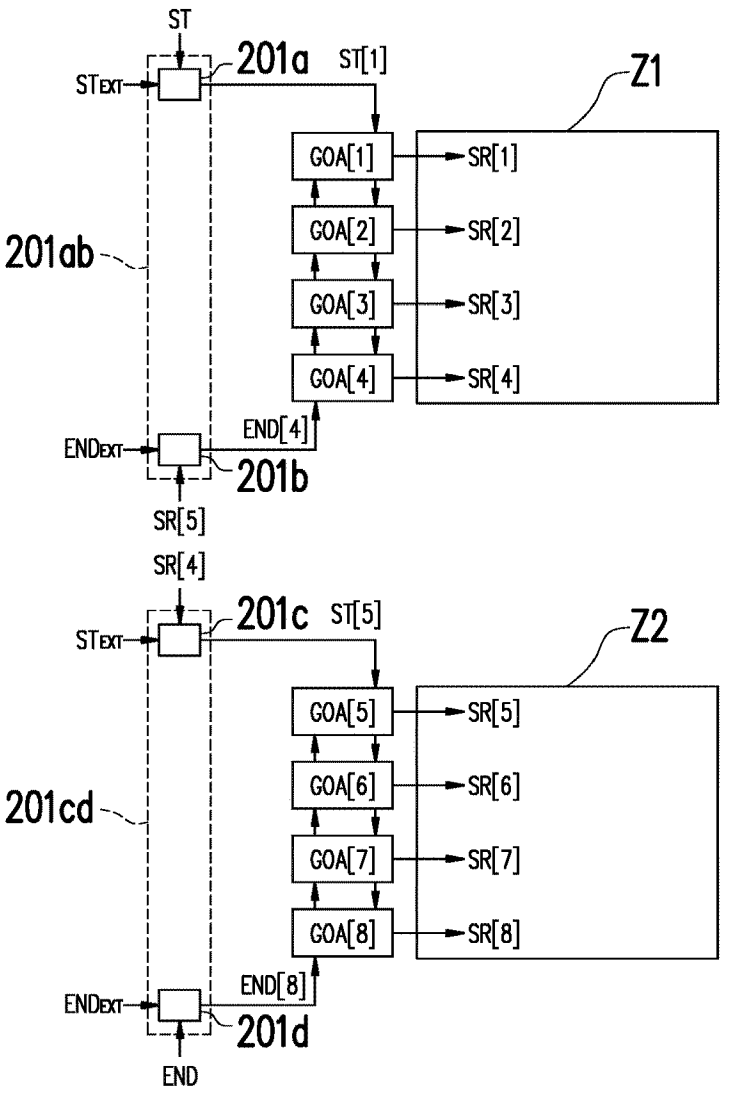

FIG. 2A is a schematic diagram of a display driving circuit 200 according to an embodiment of the invention. The display driving circuit 200 includes at least one gate driving circuit including gate driving circuits GOA[1] to GOA[8] and enable-selecting circuits 201*a* to 201*d*. For the convenience of description, in FIG. 2A, a display frame is set to have two zones to be locally updated, that is, a first zone Z1 and a second zone Z2 (but a number of the zones is not limited thereto and may be greater than two). Further, a pixel of each of the zones to be locally updated is driven by four groups of the gate driving circuits, that is, the GOA[1] to GOA[4] (but are not limited thereto, as long as the pixel is driven by at least one group of the gate driving circuit). The pixel of the first zone Z1 receives driving signals SR[1] to SR[4] sequentially generated by the gate driving circuits GOA[1] to GOA[4] in time and sequentially updates pixel data in time corresponding to the driving signals SR[1] to SR[4]. The pixel of the second zone Z2 receives driving signals SR[5] to SR[8] sequentially generated by the gate driving circuits GOA[5] to GOA[8] in time and sequentially updates pixel data in time corresponding to the driving signals SR[5] to SR[8].

In FIG. 2A, the enable-selecting circuits 201*a* to 201*d* include a plurality of selectors, registers, and gates, as shown in FIG. 2B to FIG. 2C. Each of the zones to be locally updated includes two groups of the enable-selecting circuits. For instance, the first zone Z1 includes the enable-selecting circuits 201*a* and 201*b*, and the second zone Z2 includes the enable-selecting circuits 201*c* and 201*d*. The enable-selecting circuit 201*a* is configured to generate a zone start-updating signal of the first zone Z1, the enable-selecting circuit 201*b* is configured to generate a zone end-updating signal of the first zone Z1, the enable-selecting circuit 201*c* is configured to generate a zone start-updating signal of the second zone Z2, and the enable-selecting circuit 201*d* is configured to generate a zone end-updating signal of the second zone Z2. In FIG. 2A, the display frame is set to have two zones to be locally updated, and four groups of the enable-selecting circuits are thereby included.

As shown in FIG. 2A to FIG. 2C, the enable-selecting circuit 201*a* selects auxiliary start-updating signals ST and $ST_{EXT}$ and selects one of the auxiliary start-updating signals ST and $ST_{EXT}$ to act as a zone start-updating signal ST[1] according to a selection signal $PR_{EN_1}$. The enable-selecting circuit 201*b* selects the driving signal SR[5] and an auxiliary end-updating signal $END_{EXT}$ and selects one of the selection signal SR[5] and the auxiliary end-updating signal $END_{EXT}$ to act as a zone end-updating signal END[4] according to a selection signal $PR_{EN_4}$. The enable-selecting circuit 201*c* selects the driving signal SR[4] and an auxiliary start-updating signal $ST_{EXT}$ and selects one of the driving signal SR[4] and the auxiliary start-updating signal $ST_{EXT}$ to act as a zone start-updating signal ST[5] according to a selection signal $PR_{EN_5}$. The enable-selecting circuit 201*d* selects an auxiliary end-updating signals END and $END_{EXT}$ and selects one of the auxiliary end-updating signals END and $END_{EXT}$ to act as a zone end-updating signal END[8] according to a selection signal $PR_{EN_8}$. When the selection signals ($PR_{EN_1}$, $PR_{EN_4}$, $PR_{EN_5}$, and $PR_{EN_8}$) have a first logic level (e.g., a high level), the selector selects a signal connected to an input terminal "1" of the selector to be outputted. When the selection signals have a second logic level (e.g., a low level), the selector selects a signal connected to an input terminal "0" of the selector to be outputted. Taking the enable-selecting circuit 201*c* for example, when the selection signal $PR_{EN_5}$ has the first logic level, the selector selects the auxiliary start-updating signal $ST_{EXT}$ to be outputted, and when the selection signal $PR_{EN_5}$ has the second logic level, the selector selects the driving signal SR[4] to be outputted.

Figure 3B:
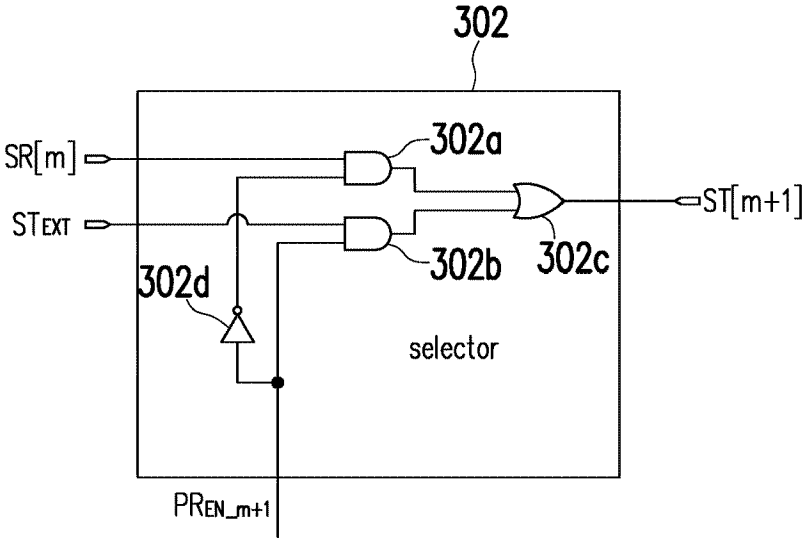
FIG. 3A to FIG. 3C are schematic diagrams showing a specific structure of an enable-selecting circuit in the display driving circuit shown in FIG. 2B.
Figure 3C:
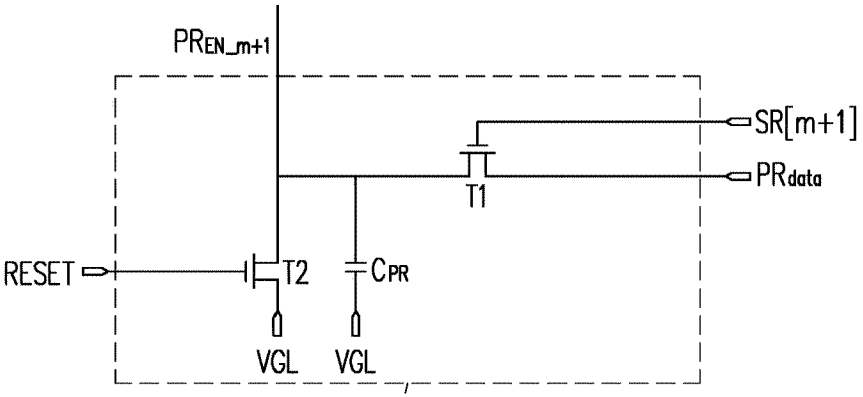
Figure 3A:
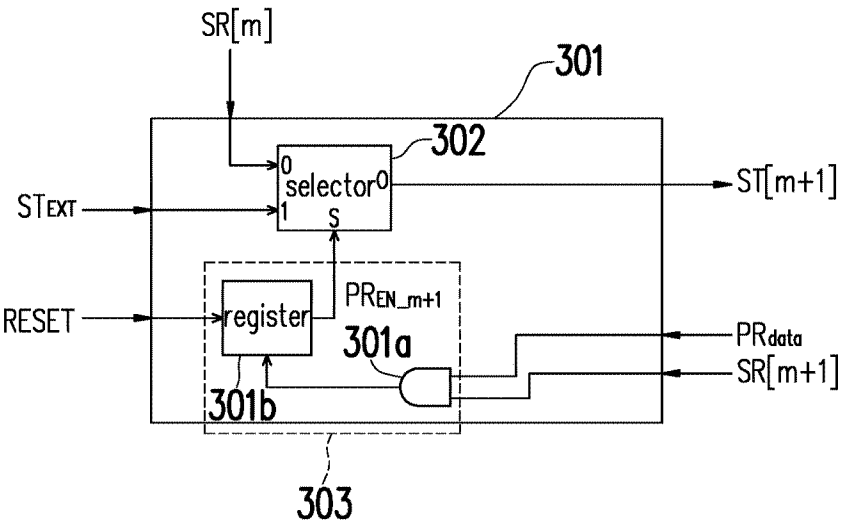

FIG. 3A to FIG. 3C are schematic diagrams showing a specific structure of the enable-selecting circuit 201*c* shown in FIG. 2B. An enable-selecting circuit 301 of FIG. 3A is similar to the enable-selecting circuit 201*c* of FIG. 2B, and a difference therebetween is that input and output signals of the enable-selecting circuit 301 are presented in a general manner. For instance, in FIG. 3A, when m=4, the input and output signals of the enable-selecting circuit 301 are identical to that of the enable-selecting circuit 201*c* of FIG. 2B.

With reference to FIG. 2A to FIG. 2C and FIG. 3A to FIG. 3C, a selector 302 in the enable-selecting circuit 301 includes a first AND gate 302*a*, a second AND gate 302*b*, a first OR gate 302*c*, and a first inverter gate 302*d*. An output terminal of the first AND gate 302*a* is connected to a first input terminal of the first OR gate 302*c*, and an output terminal of the second AND gate 302*b* is connected to a second input terminal of the first OR gate 302*c*. A first input terminal of the first AND gate 302*a* is connected to the driving signal SR[m] (e.g., through the connection manner connecting the selector of the enable-selecting circuit 201*c* and the driving signal SR[4]), the auxiliary start-updating signal ST (e.g., through the connection manner connecting the selector of the enable-selecting circuit 201*a* and the auxiliary start-updating signal ST), or the auxiliary end-updating signal END (e.g., through the connection manner connecting the selector of the enable-selecting circuit 201*d* and the auxiliary end-updating signal END). A second input terminal of the first AND gate 302*a* is connected to an output terminal of the first inverter gate 302*d*. A first input terminal of the second AND gate 302*b* is connected to the auxiliary start-updating signal $ST_{EXT}$ (e.g., through the connection manner connecting the selectors of the enable-selecting circuits 201*a* and 201*c* and the auxiliary start-updating signal $ST_{EXT}$) or the auxiliary end-updating signal $END_{EXT}$ (e.g., through the connection manner connecting the selectors of the enable-selecting circuits 201*b* and 201*d* and the auxiliary end-updating signal $END_{EXT}$). A second input terminal of the second AND gate 302*b* is connected to an input terminal of the first inverter gate 302*d*. The first OR gate 302*c* outputs one of the auxiliary start-updating signals ST and $ST_{EXT}$, one of the auxiliary end-updating signals END and $END_{EXT}$, or the corresponding driving signal SR[m] to one of the at least one corresponding gate driving circuit. The first inverter gate 302*d* inputs a corresponding selection signal $PR_{EN_m+1}$.

An equivalent circuit 303 of a register 301*b* and an And gate 301*a* in the enable-selecting circuit 301 is as a logic operation circuit. The logic operation circuit is used to perform a logic operation on the zone scan-control signal and a current stage driving signal to generate the selection signal, and includes first-type transistors T1 and T2 and a capacitor $C_{PR}$. The first-type transistor T1 is as a logic operator and controlled by a corresponding driving signal SR[m+1] to be turned on or turned off, and the first-type transistor T2 is controlled by a signal RESET to be turned on or turned off. A first input terminal of the first-type transistor T1 includes a zone scan-control signal $PR_{data}$. A second terminal of the first-type transistor T1 and a first terminal of the first-type transistor T2 are connected to one terminal of the capacitor $C_{PR}$. The other terminal of the capacitor $C_{PR}$ and a second terminal of the first-type transistor T2 are connected to a gate low voltage VGL. When the driving signal SR[m+1] corresponding to the enable-selecting circuit 301 has the first logic level, the capacitor $C_{PR}$ stores and treats the zone scan-control signal $PR_{data}$ as the corresponding selection signal $PR_{EN_m+1}$. In addition, the first-type transistor T1 in the enable-selecting circuit 301 may be formed by a same type of transistor in a corresponding dummy pixel.

Two different modes providing local update and full update of the display frame are described as follows.

With reference to FIG. 2A to FIG. 2C, FIG. 3A to FIG. 3C, and FIG. 4, when the display frame is operated in a full frame update mode $T_{FULL_1}$, the gate driving circuits GOA[1] to GOA[8] sequentially generate the driving signals SR[1] to SR[8] in time to a display pixel of a full frame, so that the corresponding display pixel sequentially updates pixel data in time. In the full frame update mode, the zone scan-control signal $PR_{data}$ is set to have the second logic level. In this way, the selection signals (selection signals $PR_{EN_1}$, $PR_{EN_4}$, $PR_{EN_5}$, and $PR_{EN_8}$) in the enable-selecting circuits 201*a* to 201*d* all have the second logic level. At this time, the enable-selecting circuit 201*a* selects the auxiliary start-updating signal ST to act as the zone start-updating signal ST[1], and the enable-selecting circuit 201*d* selects the auxiliary end-updating signal END to act as the zone end-updating signal END[8].

When the display frame is switched from the full frame update mode to a partial frame update mode ($T_{PART_1}$, i.e., a local zone update mode), the zone scan-control signal $PR_{data}$ is set to have the first logic level when entering a time span in a previous image frame time (i.e., an image frame [n−1] of FIG. 4, n is a positive integer) of the partial frame update mode. The time span is determined according to which zone is the zone where the display frame is to be locally updated and the driving signal corresponding to the zone. For instance, if the second zone Z2 is the zone where the display frame is to be locally updated, the zone scan-control signal $PR_{data}$ is set to have the first logic level within the time span when the driving signals SR[5] to SR[8] appear and is set to have the second logic level other than the time span when the driving signals SR[5] to SR[8] appear in the image frame [n−1]. Accordingly, the selection signals $PR_{EN_5}$ and $PR_{EN_8}$ are correspondingly changed to the first logic level, and the selection signals $PR_{EN_1}$ and $PR_{EN_4}$ are maintained to have the second logic level.

Figure 4:
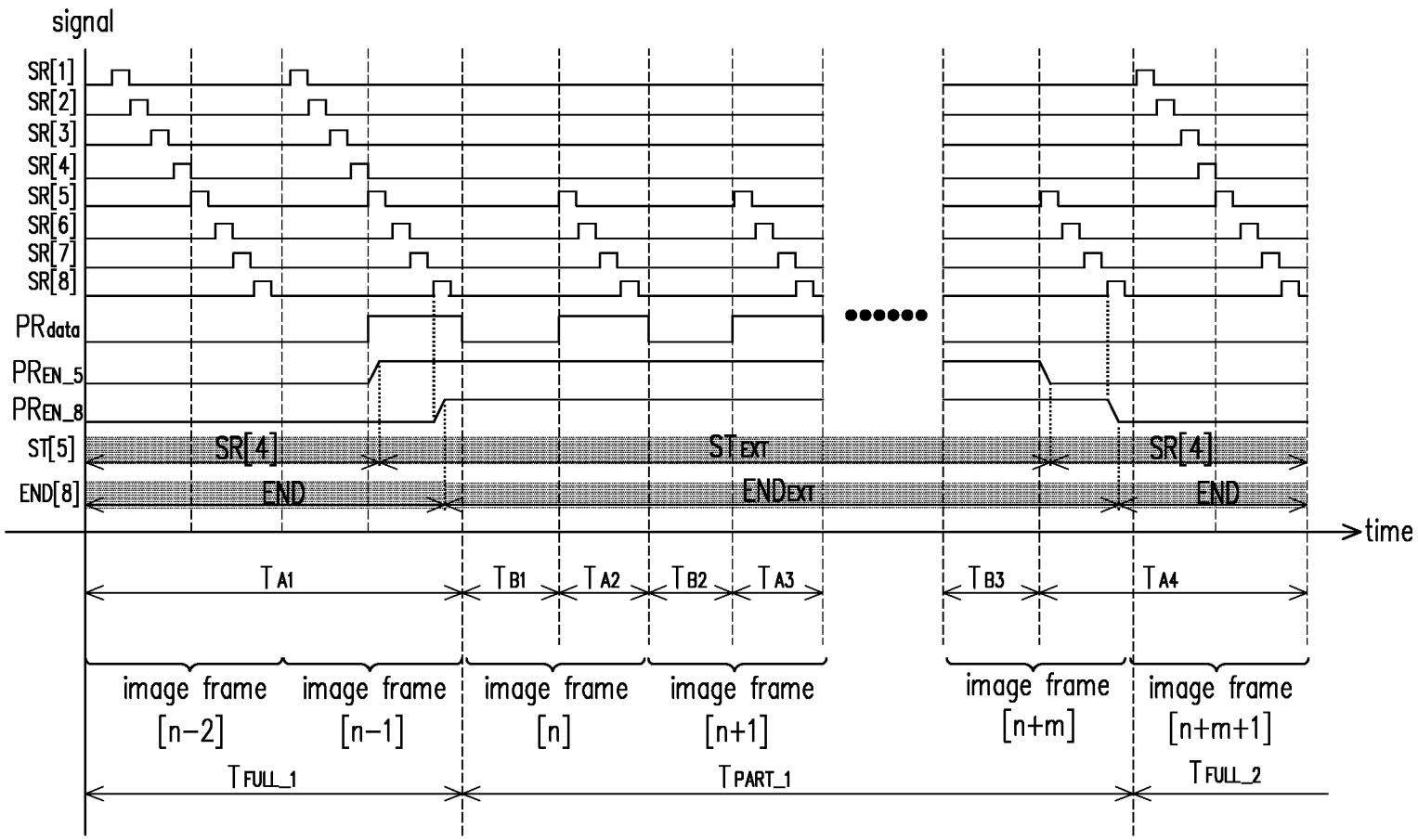
FIG. 4 is a timing diagram showing part of signals of the display driving circuits shown in FIG. 2A to FIG. 2C.

After the display frame enters the partial frame update mode (i.e., the time spans of an image frame [n] to an image frame [n+m−1] in FIG. 4, m is a positive integer), the same manner configured to set the zone scan-control signal $PR_{data}$ in the image frame [n−1] is used to set the zone scan-control signal $PR_{data}$ in each image frame time of each of the image frame [n] to the image frame [n+m−1]. Accordingly, in the time spans of the image frame [n] to the image frame [n+m−1], the enable-selecting circuit 201*c* selects the auxiliary start-updating signal $ST_{EXT}$ to act as the zone start-updating signal ST[5], and the enable-selecting circuit 201*d* selects the auxiliary end-updating signal $END_{EXT}$ to act as the zone end-updating signal END[8]. Therefore, in the partial frame update mode, only the gate driving circuits GOA[5] to GOA[8] generate the driving signals SR[5] to SR[8], and the gate driving circuits GOA[1] to GOA[4] do not generate the driving signals SR[1] to SR[4]. As such, in the time spans of the image frame [n] to the image frame [n+m−1], in the display frame, only the second zone Z2 is updated, and the first zone Z1 is not updated.

When the display frame is switched from the partial frame update mode to a full frame update mode TFULL_2, the zone scan-control signal $PR_{data}$ is set to have the second logic level when entering the previous image frame time (i.e., the image frame [n+m] of FIG. 4) of the full frame update mode. Accordingly, the selection signals $PR_{EN_5}$ and $PR_{EN_8}$ are correspondingly changed to have the second logic level, so that all the selection signals ($PR_{EN_1}$, $PR_{EN_4}$, $PR_{EN_5}$, and $PR_{EN_8}$) in the enable-selecting circuits 201*a* to 201*d* have the second logic level. At this time, the enable-selecting circuit 201*a* selects the auxiliary start-updating signal ST to act as the zone start-updating signal ST[1], and the enable-selecting circuit 201*d* selects the auxiliary end-updating signal END to act as the zone end-updating signal END[8].

The two different modes providing local update and full update of the display frame are described above, and the second zone Z2 is taken as an example to be the zone where the display frame is locally updated, but the invention is not limited thereto. If the first zone Z1 is the zone where the image frame is locally updated, in the image frame [n−1] to the image frame [n+m−1], the zone scan-control signal $PR_{data}$ only has to be set to have the first logic level within the time span when the driving signals SR[1] to SR[4] appear and be set to have the second logic level other than the time span when the driving signals SR[1] to SR[4] appear instead. The first zone Z1 may also be set to be the zone where the image frame is locally updated.

If the display frame has two or more zones to be locally updated, with reference to FIG. 2A, the enable-selecting circuit may be disposed to each of the zones to be locally updated, and the zones where the image frame is locally updated may be dynamically adjusted according to the setting manner of the zone scan-control signal $PR_{data}$ described above.

Figure 5:
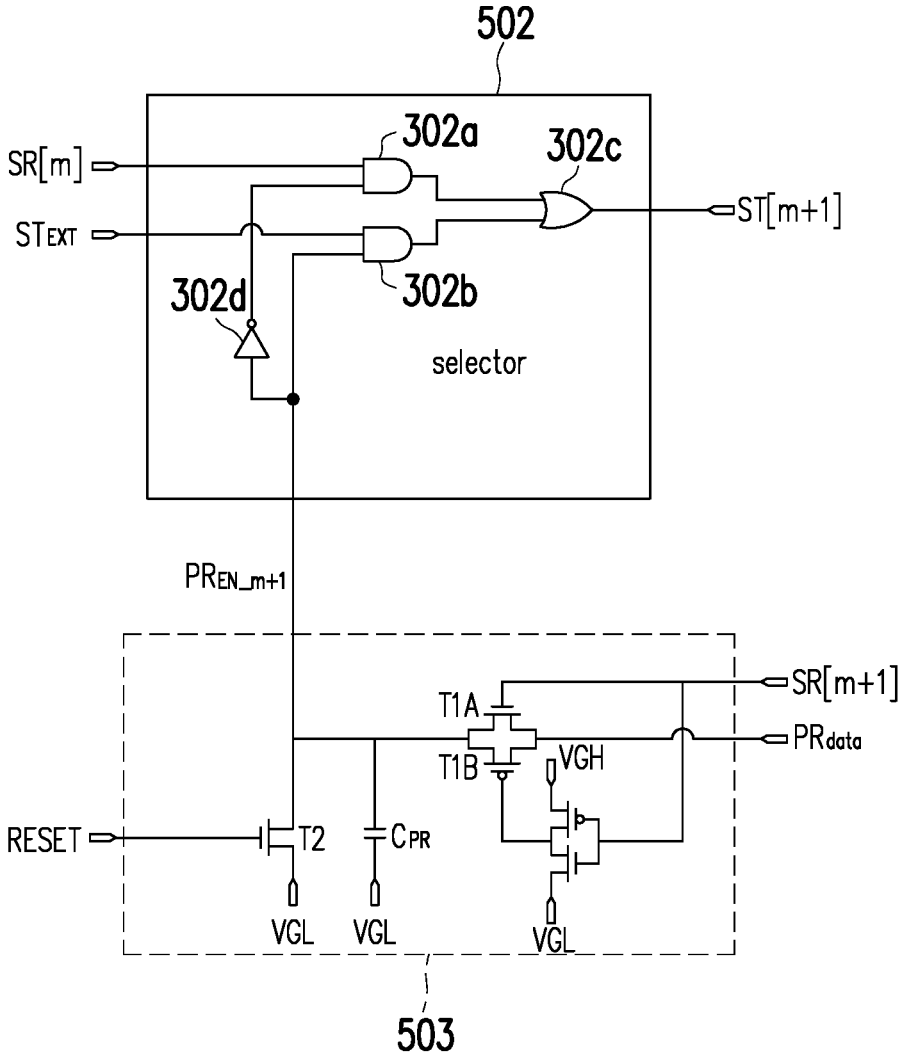
FIG. 5 is schematic diagram showing another specific structure of the enable-selecting circuit shown in FIG. 3A.
Figure 6D:
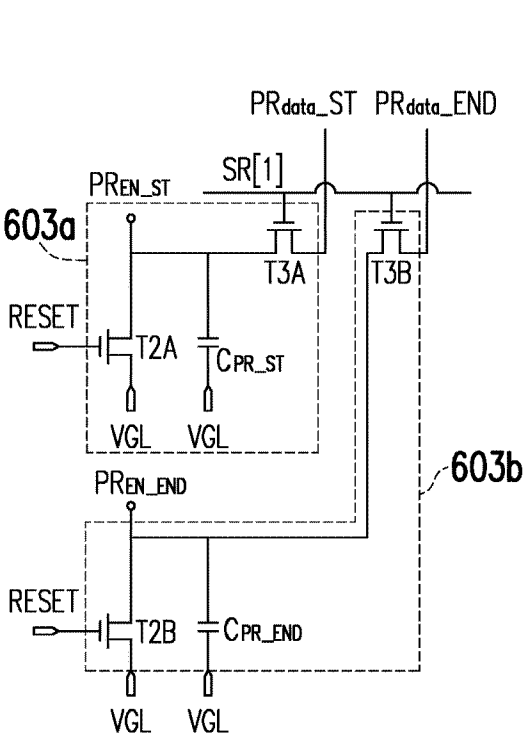
FIG. 6A to FIG. 6D are schematic diagrams of a display driving circuit according to another embodiment of the invention.
Figure 6B:
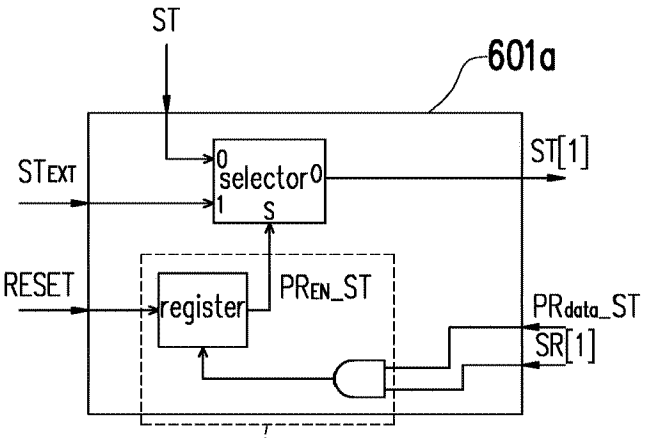
Figure 6C:
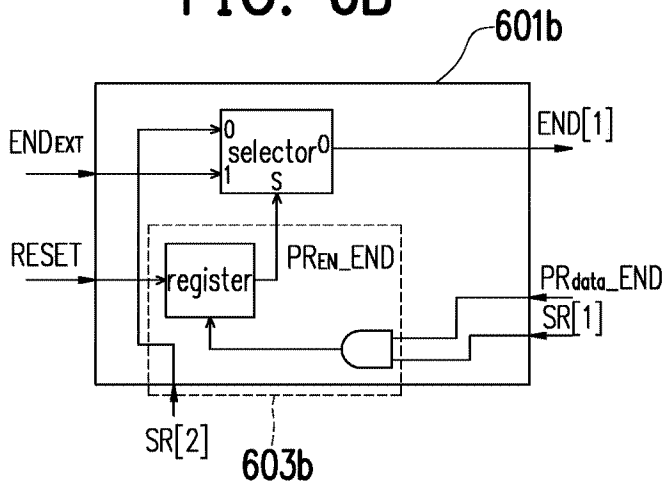
Figure 6A:
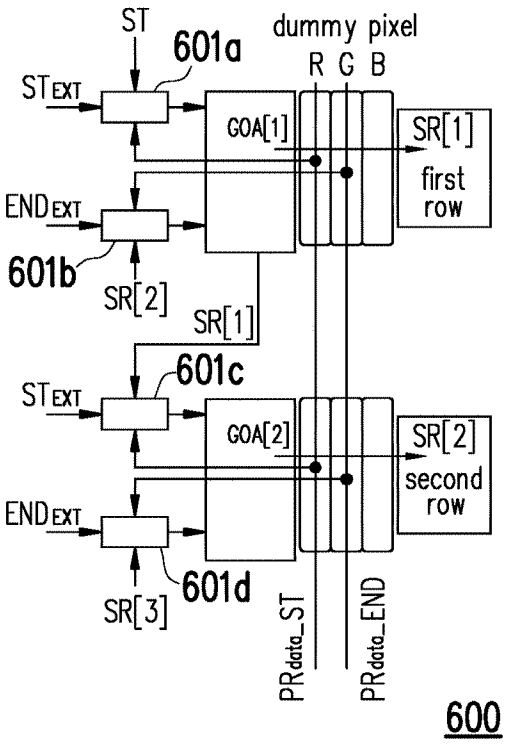

FIG. 5 is schematic diagram showing another specific structure of the enable-selecting circuit 301 shown in FIG. 3A. An enable-selecting circuit 501 includes a selector 502 and an equivalent circuit 503. Herein, the selector 502 is identical to the selector 302, and the equivalent circuit 503 further includes a second-type transistor T1B and a second inverter gate compared to the equivalent circuit 303. The second inverter gate inputs the corresponding driving signal SR[m+1]. The second-type transistor T1B is connected to the first-type transistor T1A in parallel, and a control terminal of the second-type transistor T1B is connected to an output terminal of the second inverter gate.

FIG. 6A to FIG. 6D are schematic diagrams of a display driving circuit 600 according to another embodiment of the invention. The difference between the display driving circuit 600 and the display driving circuit 200 of FIG. 2A is that two adjacent enable-selecting circuits are disposed to correspond to the same gate driving circuit in the display driving circuit 600. For instance, the enable-selecting circuits 601*a* and 601*b* are disposed to correspond to the gate driving circuit GOA[1], the enable-selecting circuits 601*c* and 601*d* are disposed to correspond to the gate driving circuit GOA[2], and the rest may be deduced by analogy. Accordingly, a register in the enable-selecting circuit 601*a* and a first-type transistor T3A in an equivalent circuit 603*a* of an AND gate may be formed by a dummy pixel R in a dummy pixel corresponding to the enable-selecting circuit 601*a*. A register in the enable-selecting circuit 601*b* and a first-type transistor T3B in an equivalent circuit 603*b* of an AND gate may be formed by a dummy pixel G in the same dummy pixel corresponding to the enable-selecting circuit 601*b*. The enable-selecting circuits 601*a* to 601*d* may occupy less screen border area through the zone scan-control signals $PR_{data}$_ST and $PR_{data}$_END from the dummy pixel, and a single row in the display frame may be dynamically updated.

In view of the foregoing, in the display driving circuits 200 and 600 provided by the invention, the start/end-updating signal may be dynamically generated to each of the zones to be locally updated to locally update the display frame. Further, the screen borders occupied by the display driving circuits 200 and 600 are not affected by the number of the zones to be locally updated in the display frame, and therefore, the slim border effect is provided and power saving is achieved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A driving circuit of a display, comprising:

a plurality of gate driving circuit groups, respectively corresponding to a plurality of display regions of the display, each of the gate driving circuit groups generating a plurality of driving signals to drive each of the corresponding display regions; and a plurality of scan-control signal generators, respectively corresponding to the gate driving circuit groups, wherein a Nth stage scan-control signal generator receives a front stage driving signal, a rear stage driving signal, an auxiliary start-updating signal, and an auxiliary end-updating signal, selects one of the front stage driving signal and the auxiliary start-updating signal to generate a zone start-updating signal according to a zone scan-control signal, and selects one of the rear stage driving signal and the auxiliary end-updating signal to generate a zone end-updating signal according to the zone scan-control signal, wherein the Nth stage gate driving circuit group performs a gate scanning action according to the zone start-updating signal and the zone end-updating signal, and N is a positive integer.

2. The driving circuit of the display as claimed in claim 1, wherein the Nth stage scan-control signal generator comprises:

a first enable-selecting circuit, selecting one of the front stage driving signal and the auxiliary start-updating signal to generate the zone start-updating signal according to the zone scan-control signal; and a second enable-selecting circuit, selecting one of the rear stage driving signal and the auxiliary end-updating signal to generate the zone end-updating signal according to the zone scan-control signal.

3. The driving circuit as claimed in claim 2, wherein the first enable-selecting circuit comprises:

a selector, receiving the front stage driving signal and the auxiliary start-updating signal, selecting the front stage driving signal or the auxiliary start-updating signal to generate the zone start-updating signal according to a selection signal; and a logic operation circuit, performing a logic operation on the zone scan-control signal and a current stage driving signal to generate the selection signal.

4. The driving circuit as claimed in claim 3, wherein the selector comprises:

a first AND gate, having a first input terminal for receiving the front stage driving signal;

a second AND gate, having a first input terminal for receiving the auxiliary start-updating signal;

an OR gate, having two input terminals respectively coupled to output terminals of the first AND gate and the second AND gate, and the OR gate having an output terminal of the OR gate generating the zone start-updating signal; and an inverter, having an input terminal coupled to a second input terminal of the second AND gate and receiving the selection signal, an output terminal of the inverter coupled to a second input terminal of the first AND gate.

5. The driving circuit as claimed in claim 3, wherein the logic operation circuit comprises:

a register, receiving an operation result and a reset signal, registering the operation result to generate the selection signal or performing a reset action according to the reset signal;

a logic operator, coupled to the register, performing a logic operation on the zone scan-control signal and the current stage driving signal to generate the operation result.

6. The driving circuit as claimed in claim 5, wherein the register comprises:

a first transistor, a first terminal of the first transistor generating the selection signal, a control terminal of the first transistor receiving the reset signal, and a second terminal of the first transistor receiving a gate low voltage; and a first capacitor, coupled between the first terminal and the second terminal of the first transistor, the logic operator comprising:

a second transistor, a first terminal of the second transistor coupled to the first terminal of the first transistor, a control terminal of the second transistor receiving the current stage driving signal, and a second terminal of the second transistor receiving the zone scan-control signal.

7. The driving circuit as claimed in claim 6, wherein both the first transistor and the second transistor are N-type transistors.

8. The driving circuit as claimed in claim 1, wherein the first stage scan-control signal generator further receives a full zone start signal and selects one of the full zone start signal and an auxiliary start signal to generate a corresponding zone start signal according to the zone scan-control signal.

9. The driving circuit as claimed in claim 1, wherein the last stage scan-control signal generator further receives a full zone end signal and selects one of the full zone end signal and a zone end signal to generate the corresponding zone end signal according to the zone scan-control signal.

10. The driving circuit as claimed in claim 5, wherein the register comprises:

a third transistor, a first terminal of the third transistor generating the selection signal, a control terminal of the third transistor receiving the reset signal, a second terminal of the third transistor receiving a gate low voltage; and a second capacitor, coupled between the first terminal and the second terminal of the third transistor, the logic operator comprising:

a switch, a first terminal of the switch coupled to the first terminal of the third transistor, a second terminal of the switch receiving the zone scan-control signal, a first control terminal of the switch coupled to an output terminal of an inverter, a second control terminal of the switch coupled to an input terminal of the inverter, the input terminal of the inverter receiving the current stage driving signal.

11. The driving circuit as claimed in claim 6, wherein the second transistor of the first enable-selecting circuit is formed by a same type of transistor in a dummy pixel corresponding to the first enabled-selecting circuit.

12. The driving circuit as claimed in claim 11, wherein the first enable-selecting circuit and the second enable-selecting circuit correspond to the same dummy pixel.

* * * * *